US005219137A

United States Patent [19]

Stepanek et al.

[11] Patent Number: 5,219,137

[45] Date of Patent: Jun. 15, 1993

[54] DISPLAY DEVICE FOR SKI BINDINGS

[75] Inventors: Premek Stepanek, Garmisch-Partenkirchen; Ludwig Wagner, Farchant, both of Fed. Rep. of Germany

[73] Assignee: Marker Deutschland GmbH, Eschenlohe, Fed. Rep. of Germany

[21] Appl. No.: 783,219

[22] Filed: Oct. 28, 1991

[30] Foreign Application Priority Data

Oct. 26, 1990 [DE] Fed. Rep. of Germany ... 9014860[U]

[51] Int. Cl.[5] ..... A47B 96/06

[52] U.S. Cl. ..... 248/221.4; 211/70.5; 280/814

[58] Field of Search ..... 248/221.3, 221.4, 222.2, 248/223.3, 200; 280/814, 816, 611; 211/70.5

[56] References Cited

U.S. PATENT DOCUMENTS

| | | | |
|---|---|---|---|
| 3,574,964 | 4/1971 | Ownbey | 248/221.4 X |
| 3,950,904 | 4/1976 | Littman | 248/221.4 X |
| 4,248,365 | 2/1981 | Jacobs | 280/814 X |
| 4,268,050 | 5/1981 | Kennedy | 280/814 X |
| 4,310,135 | 1/1982 | Dobson | 248/221.4 |
| 5,106,112 | 4/1992 | Sargent | 280/814 X |
| 5,106,143 | 4/1992 | Soeters | 248/221.4 X |

FOREIGN PATENT DOCUMENTS

| | | | |
|---|---|---|---|
| 0403675 | 12/1990 | European Pat. Off. . | |
| 91117328 | 11/1991 | European Pat. Off. . | |
| 1425758 | 12/1965 | France | 211/70.5 |
| 8102116 | 6/1982 | France . | |
| 674130 | 5/1990 | Switzerland . | |

*Primary Examiner*—J. Franklin Foss

*Attorney, Agent, or Firm*—D. Peter Hochberg; Mark Kusner

[57] ABSTRACT

A display device for a ski binding comprises two components detachably connected to each other. One end of a first component is angled upwardly from its other, lower end, while the second component comprises a structure with ski binding mounting blocks located at either end thereof, connected by two, parallel rods. One of the mounting blocks is comprised of two, stepped portions with a slot located therebetween adapted to temporarily receive a ski therethrough, permitting a purchaser to superimpose the component over a ski to determine the esthetic compatibility of the ski with a binding mounted on the component. The components can be connected to each other by positioning the lower end of the first component in the slot of the second component, the two components being held together by a detent on one of the stepped portions which extends into a recess located in the lower end of the first component. The other ends of the components are connected by the engagement of clips located on the upper end of the first component with the adjacent end of the second component. If desired, the two components may then be secured in their connected condition by means of a threaded fastener extending from one component into the other, while the first component may be secured to a wall or table by means of threaded fasteners.

10 Claims, 4 Drawing Sheets

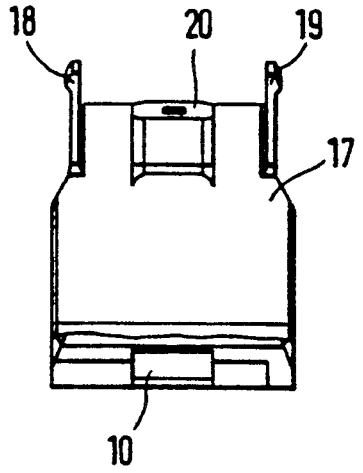
Fig.7
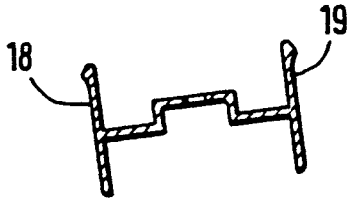
Fig.8
Fig.9
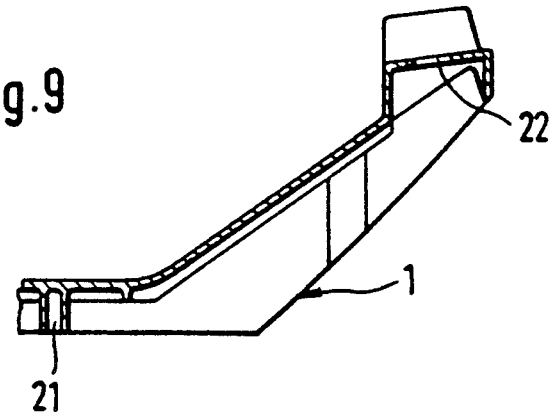
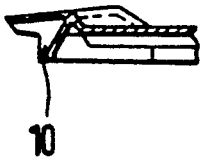
Fig.10

DISPLAY DEVICE FOR SKI BINDINGS

TECHNICAL FIELD

This invention relates to a carrying device for exhibiting and displaying ski bindings. The device, which has screw holes for mounting ski bindings thereto, can optionally be placed on a table or hung from a wall.

BACKGROUND OF THE INVENTION

Ski bindings are commonly displayed on the premises of manufacturers thereof, and are exhibited in the establishments of dealers supplied with the bindings by such manufacturers.

It has been found, however, that the devices for holding and displaying such ski bindings which have previously employed by the vendors thereof, do not satisfy the needs of those engaged in distribution and sale of the bindings. In this regard, more stylishly colored skiing outfits have been popularized in recent times, and as a consequence, ski bindings are being offered in a variety of colors and color combinations designed to complement the ski outfits. As a consequence, and to assist in the selection of bindings having compatible colors, potential buyers prefer to observe the bindings in their position of use on their own, or prospectively selected skis. However, until the discovery of the present invention, this has not been possible with previously known binding display devices.

BRIEF DISCLOSURE OF THE INVENTION

In view of the foregoing, therefore, it is an aspect of the invention to provide a ski binding display device which allows a ski binding mounted on the device to be associated with a ski, but with minimum obstruction to the viewing of the top surface of the ski by prospective purchasers of the binding.

This is accomplished in accordance with the present invention in that the display device comprises two components that are detachably interconnected, the first component being provided with at least one platform surface, and the second component with holes for receiving the attachment screws of a ski binding. Owing to the separability of the components, the component on which the ski binding is mounted can be separated from the first component and can thereafter be associated with a ski, while the first component remains fixed in its initial position. As a result, the color compatibility and also the general appearance of the bindings and skis which are to be combined can be evaluated in conjunction with each other by purchasers thereof.

According to a further feature of the invention, the first and second components of the display device can be juxtaposed, one over the other, and can be engaged and detachably connected with each other. Desirably, the second component has a slot-like opening therein for receiving and securing one end of the component. Because the components are arranged one over the other, and since the second component, that carrying the ski binding can be removed from the other, first component, a plurality of closely spaced binding display devices can be arranged on a table for exhibition in a relatively small space.

According to a preferred feature, the slot of the second component, which carries the ski binding, comprises a transverse opening in the component so that one of the portions of the second component carrying part of the ski binding is separated by the opening from another, coupling portion thereof, the latter portion preferably being formed with a step having a height or elevation relative to the former portion that corresponds to the maximum thickness of a ski. As a result, the second component of the display device on which the ski binding is to be mounted can be removed from the first component and thereafter temporarily placed on a ski in a process similar to engaging a bayonet joint, i.e., being rotatable on the ski from a relatively oblique position relative thereto, to a position in which the component is parallel to the ski with the lower stepped coupling portion extending beneath the ski. The binding will then be substantially positioned as it would be as if mounted for use on the ski, and a prospective purchaser can determine whether or not he or she likes the selected combination.

If the ski binding to be exhibited consists of a toe unit and a heel unit, the second component of the display device desirably comprises two mounting blocks adapted to receive respective units of the ski binding, the mounting blocks being interconnected by two parallel rods. The rods may consist, i.e., of round wire, while the mounting blocks may be substantially H-shaped. The ends of the legs of the H may be connected to the rods in such a manner that its web extends between, and parallel to the two rods. With such a configuration, the second component of the display device can be temporarily placed on a ski, superimposed over the skis' binding-mounting area, but will only obscure other areas of the top surface of the ski to a minor extent so that viewers observation of the ski will be virtually unimpaired.

If two mounting blocks for supporting the ski binding are provided, one of the mounting blocks comprising two spaced and stepped portions will form the opening for receiving one end of the first component of the display device.

According to a further feature of the invention, the first component of the display device comprises a plate provided with one of its two ends angled upwardly with respect to the opposite end, being elevated relative to the latter. In such case, when the two components of the display device are interconnected, they appear in side elevation to form a triangle, the longest side which is formed by the second component, i.e., the component on which the ski binding is mounted. The angled end of the first component is preferably provided on each of its two longitudinal sides with a flexible hooked tongue, which serves as an attachment arm for connecting the angled end to the corresponding end of the second component.

In some instances, during an exhibition of ski bindings, it may be desirable to prevent separation of the two components of the display device from each other, for instance, in order to prevent theft or other misadventure. Such a situation would occur, for example, when the exhibited ski bindings are located where they are freely accessible to the viewing public with no supervision. In such circumstances, certain security measures are desirably provided such as a screw capable of fastening the two components together, the screw being inaccessible when the first component of the device has been securely fastened to a table or to a wall.

BRIEF DESCRIPTION OF THE DRAWINGS

An illustrative embodiment of the invention will now be described with reference to the accompanying drawings, in which like numbers refer to like parts, and in which:

FIG. 7 is an end elevation of the component of FIG. 4;

FIG. 8 is a cross-sectional view taken along line VIII—VIII of FIG. 5;

FIGS. 9 and 10 are cross-sectional views taken along lines IX—IX and X—X, respectively, of FIG. 6;

DETAILED DESCRIPTION OF THE INVENTION

The display device of the invention comprises the two components, 1 and 2, which are detachably interconnected. The first component 1 has a supporting surface 3, which among other things, serves to support the display device on a table, or assists in hanging the device on a wall. The second component 2 has a number of holes, 4 and 5, for receiving the mounting screws of the ski binding, not shown, which is intended to be exhibited.

Figures 1, 2, 3:
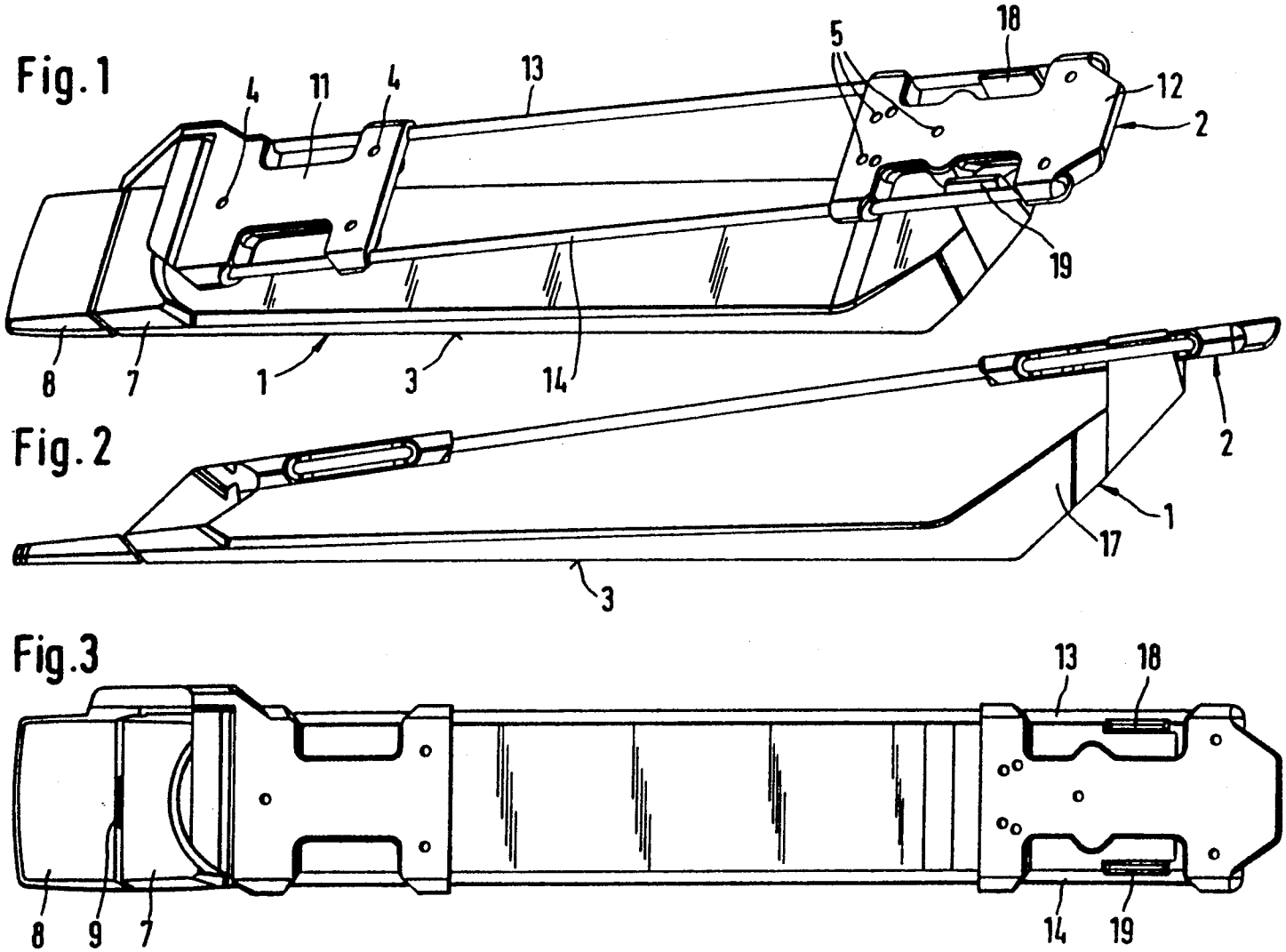
FIG. 1 is a perspective view showing the display device of the invention.
FIG. 2 is a side elevation showing the display device of FIG. 1.
FIG. 3 is a top plan view showing the display device.
Figure 11:
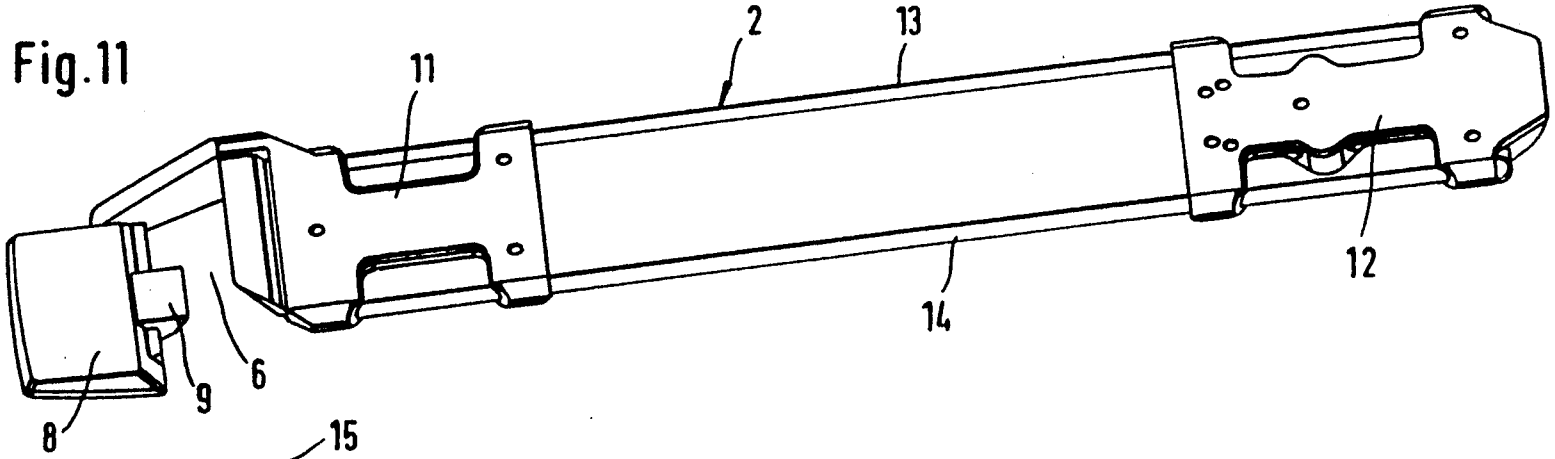
FIG. 11 is a perspective view showing the second component of the display device.
Figure 12:
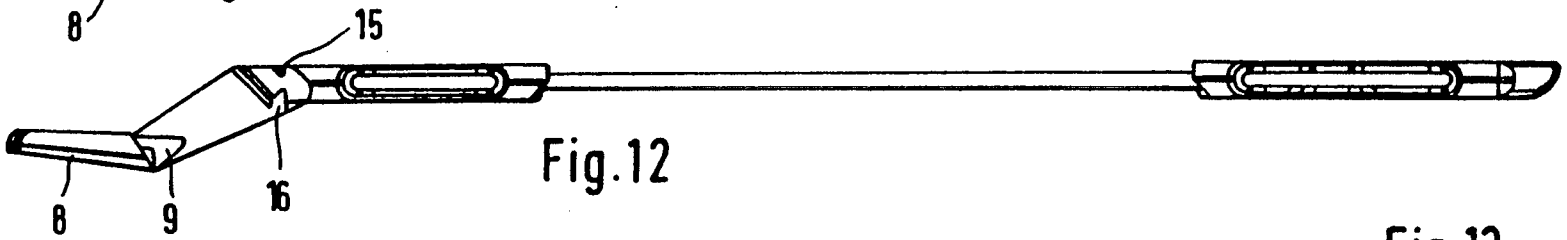
FIG. 12 is a side elevation showing the component of FIG. 11.
Figure 13:
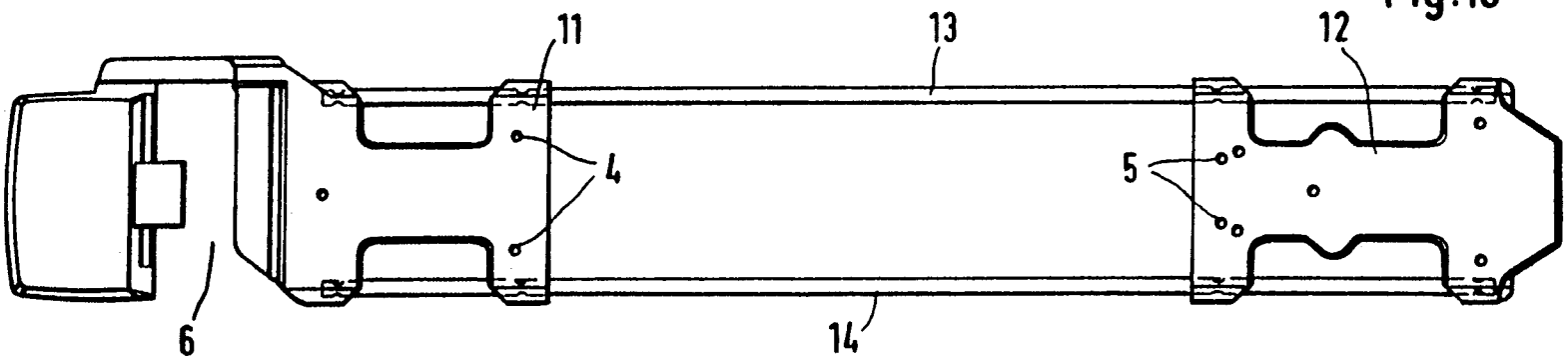
FIG. 13 is a top plan view showing the component of FIG. 11.

From FIGS. 1 through 3, it can be seen that the components 1 and 2 are designed for juxtaposition, one over the other. As illustrated in the figures, the two components are detachably interconnected with each other, component 2 having a slot or opening, as illustrated in FIGS. 11 and 13, for the purpose of facilitating such interconnection. The slot is comprised of a transverse opening 6 which serves to receive the forward end portion 7 of component 1. As is particularly apparent from FIG. 12, the receiving opening is partially defined by the forward portion 8 of component 2. The forward coupling portion 8, which is lower or "stepped" downwardly relative to the other portion of mounting block 11, and which borders the opening 6, has a "nose" or detent 9, which is adapted to fit into a recess 10 in the forward end portion 7 of component 1, thereby holding component 2 in position at the forward end of component 1.

Component 2 includes two mounting blocks, 11 and 12, which are interconnected by two parallel rods 13 and 14. The two portions of mounting block 11 border on, and form the receiving opening 6. To provide some flexibility between the portion 8 of component 2, and the balance of the block which carries a part of the binding, the cross-section of the balance of the block is reduced in thickness and, therefore, made more elastic by the provision of grooves 15 and 16, as shown in FIG. 12. The mounting blocks may, for example, be made of plastic, while the rods preferably consist of round wires. The mounting blocks are fixed to the rods in any suitable manner, for example, by techniques well known in the art.

Component 1 consists of a plate having an upwardly angled rear end portion 17, which is provided on its longitudinal sides with two flexible, hooked tongues, 18 and 19, which in the assembled state of the display device engage the rods 13 and 14 so that component 2 can be fastened to component 1 at its rear end. A bracket 20 is provided between the two tongues which serves to support the rear mounting block 12.

When the display device is in its assembled condition, as shown in FIGS. 1 through 3, the two components, 1 and 2, are connected to each other at their forward ends in that the detent 9 extends into the recess 10, while at the same time the rear end of component 1 is interlocked with the rear end portion of component 2 by means of the tongues 18 and 19. The resilient interlock can be disengaged by forcibly raising the rear end of component 2. Thereafter component 2 can be moved to the left in the views shown in the figures until the detent 9 can be removed from the recess 10. Component 2 can then be separated from component 1. The two components can be connected to each other by reversing the sequence described.

Component 2 with a ski binding mounted thereon can be moved independently of component 1 over a ski so that a judgment regarding the suitability of the binding with respect to the ski can be made. As previously stated, because the forward portion 8 of component 2 is stepped with respect to the adjacent rear coupling portion of block 11 which is provided with the ski binding part, and the forward portion 8 is separated from the rear portion by the transverse opening 6, component 2 can be placed on the ski in an oblique position and can then be turned to an aligned position in which component 2 is parallel to the ski. When so positioned, the ski binding will essentially be in its normal mounting position on the ski. Because the opening in block 11 is somewhat adjustable due to the resiliency of its rear portion resulting from the presence of grooves 15 and 16, component 2 can be used with most, if not all commercially available skis, and may optionally be clamped in position.

In operation, the mounting block 11 may serve to support a binding toe unit, while the mounting block 12 may support a heel unit of a safety ski binding. Because the mounting blocks are interconnected only by the rods 13 and 14, when component 2 overlies a ski, and with the exception of the binding areas of the ski, the component will cover only very small areas of the top surface of the ski so that a viewer is better able to receive a clear impression as to the suitability of the combination of the ski binding with the ski.

As is clear from FIGS. 1 and 2, the display device in its assembled state appears in side elevation substantially in the form of a triangle. This permits a ski brake associated with the heel unit on the mounting block 12 to be viewed in its braking position.

Figure 4:
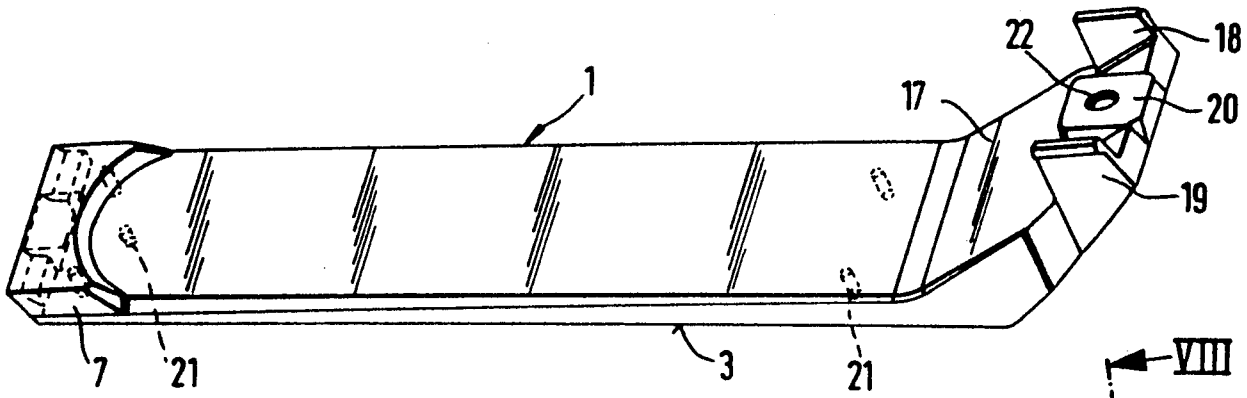
FIG. 4 is a perspective view showing the first component of the display device.
Figure 5:
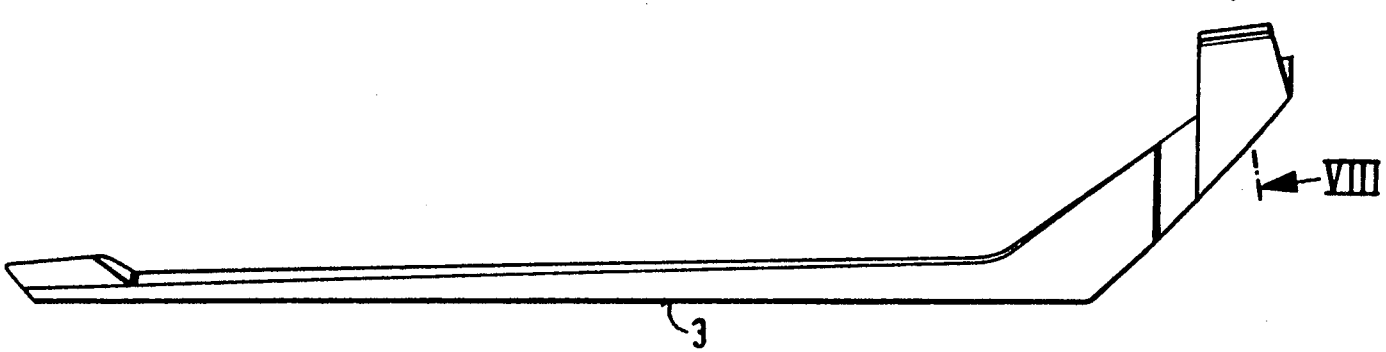
FIG. 5 is a side elevation of the component of FIG. 4.
Figure 6:
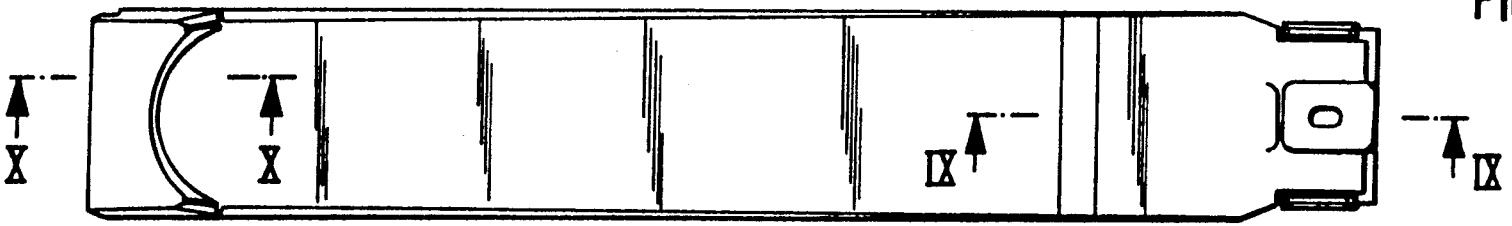
FIG. 6 is a top plan view of the component of FIG. 4.

In instances where the bindings are accessible to the public, as they are, for example, when displayed on tables during exhibitions, undesired handling and theft can be prevented by the provision of holes 21, located on the underside of component 1 as shown in FIGS. 4 and 9, such holes being adapted to receive fastening screws inserted through the table top from beneath. The bracket 20 is also provided with a hole 22, through which a fastener can be inserted and then screwed into a corresponding hole on the underside of the mounting block 12. When so connected, component 2 with its associated ski binding can no longer be detached from component 1. In such a case, installation of the screw connecting component 2 with mounting block 12 should precede the fastening of component 1 to a table since the first mentioned screw would then be inaccessible.

While in accordance with the patent statutes, a preferred embodiment and best mode has been presented, the scope of the invention is not limited thereto, but rather is measured by the scope of the attached claims.

What is claimed is:

1. A display device for a ski binding comprising a ski binding mounting component connectable to ski bindings, and a ski binding mounting support component, a first end of said binding mounting component having a slot therein adapted to receive and detachably connect with a first end of said ski binding support component, and a second end of said support component being elevated relative to its first end, and being provided with connecting means to detachably connect with a second end of said binding mounting component.

2. A display device for a ski binding comprising a ski binding mounting component, and a ski binding mounting support component, a first end of said binding mounting component having a slot therein adapted to receive and detachably connect with a first end of ski binding support component, and a second end of said support component being elevated relative to its first end, and being provided with connecting means to detachably connect with a second end of said binding mounting component wherein said ski binding mounting component is provided with a block at each end thereof, adapted to have a ski binding mounted thereon, said blocks being connected to parallel connecting rods, and said connecting means comprising spring clips adapted to engage said connecting rods.

3. A display device for a ski binding comprising a ski binding mounting component, and a ski binding mounting support component, said binding mounting support component including a first end connected with and spaced from a second end, said second end being elevated relative to said first end, and being provided with coupling means, and said binding mounting component comprising first and second ski binding mounting blocks, and a coupling portion, said mounting blocks being connected to, and spaced from each other by parallel rods, and said first block being spaced from, and elevated relative to said coupling portion, whereby when said mounting component and said mounting support components are juxtaposed, said first end is received into the space between said first mounting block and said coupling portion and an attachment part of said coupling portion engages said first end, while said coupling means engages said rods, maintaining said components in a detachably connected condition.

4. A device according to claim 3 wherein the difference in elevation between said first block and said coupling part is sufficient to accommodate the thickness of a ski positioned in said space.

5. A device according to claim 3 wherein said attachment part is a detent, and said engagement occurs when said detent is received into a recess contained in said first end.

6. A device according to claim 3 wherein said ski binding mounting blocks comprise plates adapted for mounting binding components thereon with fastening means.

7. A device according to claim 6 wherein said fastening means are threaded fasteners.

8. A device according to claim 3 in which a portion of said first mounting block is made flexible by means of grooves located therein.

9. A device according to claim 3 wherein said ski binding mounting support component is fixable to a surface with threaded fasteners, and said components can be secured to each other by means of a threaded fastener connecting said second end and said second mounting block.

10. A device according to claim 3 wherein said coupling means comprises spring clips.

* * * * *